US005722121A

United States Patent [19]

Lau et al.

[11] Patent Number: 5,722,121

[45] Date of Patent: Mar. 3, 1998

[54] ENCLOSURE HINGE

[75] Inventors: Robert Gerald Lau, Anoka; Craig E. Schinzel, Ramsey, both of Minn.

[73] Assignee: Federal-Hoffman, Inc., Anoka, Minn.

[21] Appl. No.: 607,699

[22] Filed: Feb. 27, 1996

[51] Int. Cl.[6] ..... E05D 5/12

[52] U.S. Cl. ..... 16/381; 16/389

[58] Field of Search ..... 16/381, 380, 386, 16/387, 342, 389

[56] References Cited

U.S. PATENT DOCUMENTS

| | | | |
|---|---|---|---|
| 93,058 | 7/1869 | Cole . | |
| 713,338 | 11/1902 | Paquette . | |
| 1,728,433 | 9/1929 | Mohun . | |
| 1,754,013 | 4/1930 | Fisher . | |
| 1,824,886 | 9/1931 | Hart . | |
| 1,979,894 | 11/1934 | Lyons . | |
| 2,817,871 | 12/1957 | Ferry . | |
| 2,937,399 | 5/1960 | De Vore . | |
| 2,997,734 | 8/1961 | Dyer . | |
| 3,013,297 | 12/1961 | Ferry . | |
| 3,068,508 | 12/1962 | Heyer . | |
| 3,135,013 | 6/1964 | Parsons . | |
| 3,621,512 | 11/1971 | Johnson . | |
| 3,733,649 | 5/1973 | Nagy et al. | 16/137 |
| 3,865,051 | 2/1975 | Johl et al. | 108/132 |
| 3,962,750 | 6/1976 | Buss et al. | 16/168 |
| 4,413,449 | 11/1983 | Faye | 52/16 |
| 4,455,711 | 6/1984 | Anderson | 16/229 |
| 4,475,266 | 10/1984 | Suska | 16/273 |
| 4,603,452 | 8/1986 | Paciorek | 16/262 |
| 5,282,293 | 2/1994 | Pedoeem | 16/371 |
| 5,355,559 | 10/1994 | Bowers et al. | 16/389 |

FOREIGN PATENT DOCUMENTS

| | | |
|---|---|---|
| 716946 | 12/1931 | France . |
| 2623140 A1 | 12/1977 | Germany . |
| 3314753 A1 | 10/1984 | Germany . |
| 278783 | 11/1964 | Netherlands . |

OTHER PUBLICATIONS

Exhibit A Hoffman Engineering Company Specifier's Guide, 1995–1996, p. 31 showing hinge kits.

Exhibit B Rittal brochure "The Original" Ae compact enclosure (1 page).

Exhibit C Rittal brochure "130° Hinge for PS/ES/DK Enclosure" (1 page).

*Primary Examiner*—Chuck Y. Mah

*Attorney, Agent, or Firm*—Merchant, Gould, Smith, Edell, Welter & Schmidt

[57] ABSTRACT

A hinge (20) includes a hinge body (30) pivotally connected with a hinge pin (70) to a leaf (26). The hinge body (30) includes a base (32) supporting a riser portion (36) connected to knuckles (34). The hinge body is configured so that geometry holds a pin retaining member (50). The retaining member (50) includes a portion (56) inserting into a side opening (46) of the knuckles (34) which engages angular groves (74) and (76) formed in the pin (70).

19 Claims, 7 Drawing Sheets

ENCLOSURE HINGE

BACKGROUND OF INVENTION

1. Field of the Invention

The present invention relates to a hinge, and in particular to a hinge which is self-retaining for retaining the hinge pin with the hinge body when the hinge is disassembled.

2. Description of the Prior Art

Hinges with a hinge body and complementary leaf having a pin inserting therethrough for various types of enclosures are well known. Hinges often must be disassembled to facilitate maintenance or other activities in an enclosure which require removal of the door. Hinges having a pin retaining feature provide advantages as the pin may be removed, but the pin is not misplaced or lost as may often occur. In addition, the pin is always aligned for reinsertion. Therefore, it is advantageous to provide a hinge which allows the pin to be pulled out from the hinge body to provide separation of the leaf and hinge body, while retaining the pin with one of the hinge knuckles.

It can be appreciated that hinges need to be reversed for opening the door either to the left or to the right for adapting to different enclosure configurations. Therefore, such reversible hinges provide for easier manufacturing and cheaper cost if the same hinge may be used for opening to either direction. Therefore, hinges which provide for self retaining of the pin should also provide for retaining the pin when the hinges mount to a door opening to either the left or the right.

It can be seen then that an improved hinge is needed which provides for retaining the hinge pin when the hinge is fully assembled or when the two leafs are separated. Such a hinge should also provide for utilizing a single hinge piece which is capable of retaining the pin when reversed for opening to either direction. Such a hinge should be easily and inexpensively manufactured. The present invention addresses these as well as other problems associated with self-retaining hinges.

SUMMARY OF THE INVENTION

The present invention is directed to a hinge system, and in particular, to a hinge system Which has a self-retaining feature to hold the hinge pin when the hinge is disassembled. The hinge includes a hinge body and a complementary leaf which are mounted on each of the two pivotally connected elements. The hinge pin inserts through the leaf and hinge body to retain the hinge body and the leaf in pivotal relationship. A pin retaining member mounts to the hinge body for securing the pin with the hinge body when the hinge is either assembled or disassembled.

The hinge body includes a pair of aligned knuckle portions forming tubular openings for receiving the hinge pin. The knuckle portions are connected to a base through riser portions extending upward from the base. The base includes a mounting orifice or other structure for attaching to a mounting surface. The leaf portion includes a knuckle aligning with the knuckles of the hinge body to provide for pivotal movement with the pin. The hinge body also includes openings through the side of the knuckles for receiving a pin retainer member, as explained hereinafter. The base and riser portions form an orifice for receiving an end portion of the retainer member and have an alignment member extending outward from the riser portion for engaging an orifice in the pin retaining member.

The pin retaining member includes a portion extending into the opening at the side of the knuckle which engages the pin and a portion extending to the base. The portion extending to the base includes a narrow end portion extending into the orifice formed at the base and the riser section as well as an orifice in the pin retainer for receiving the alignment member. In this manner, the resiliency of the pin retaining member flexed against the knuckle as well as the riser portion and the base holds the retainer member in position. Although each knuckle includes an opening, an alignment member and an orifice for accepting a pin retaining member, only one pin retaining member is required to hold the pin, as explained hereinafter.

The pin includes a tapered end portion as well as a first annular groove having a substantially straight radially outward extending side and a tapered side to the groove. A second annular groove includes a pair of tapering sides leading to the narrow portion of the groove. The grooves are configured so that the retainer member extending into the side opening of the knuckle engages the grooves to hold the pin substantially in position. A straight side of the first orifice prevents removal of the pin entirely from the knuckle. However, the pin retaining member is able to slide over the tapered sides of the grooves in the pin. In this manner, when the pin is fully inserted into both knuckles and the leaf, the second groove having the tapered sides engages the pin retaining member. To disassemble the hinge, the pin is pulled outward so that the pin retaining member abuts the straight side of the first groove. This allows the leaf to be pulled from the hinge body while the hinge pin is retained by the hinge body.

These features of novelty and various other advantages which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

BRIEF DESCRIPTION OF THE DRAWINGS

In the drawings, wherein like reference letters and numerals indicate corresponding elements throughout the several views.

DETAILED DESCRIPTION OF THE PREFERRED EMBODIMENT(S)

Figure 1:
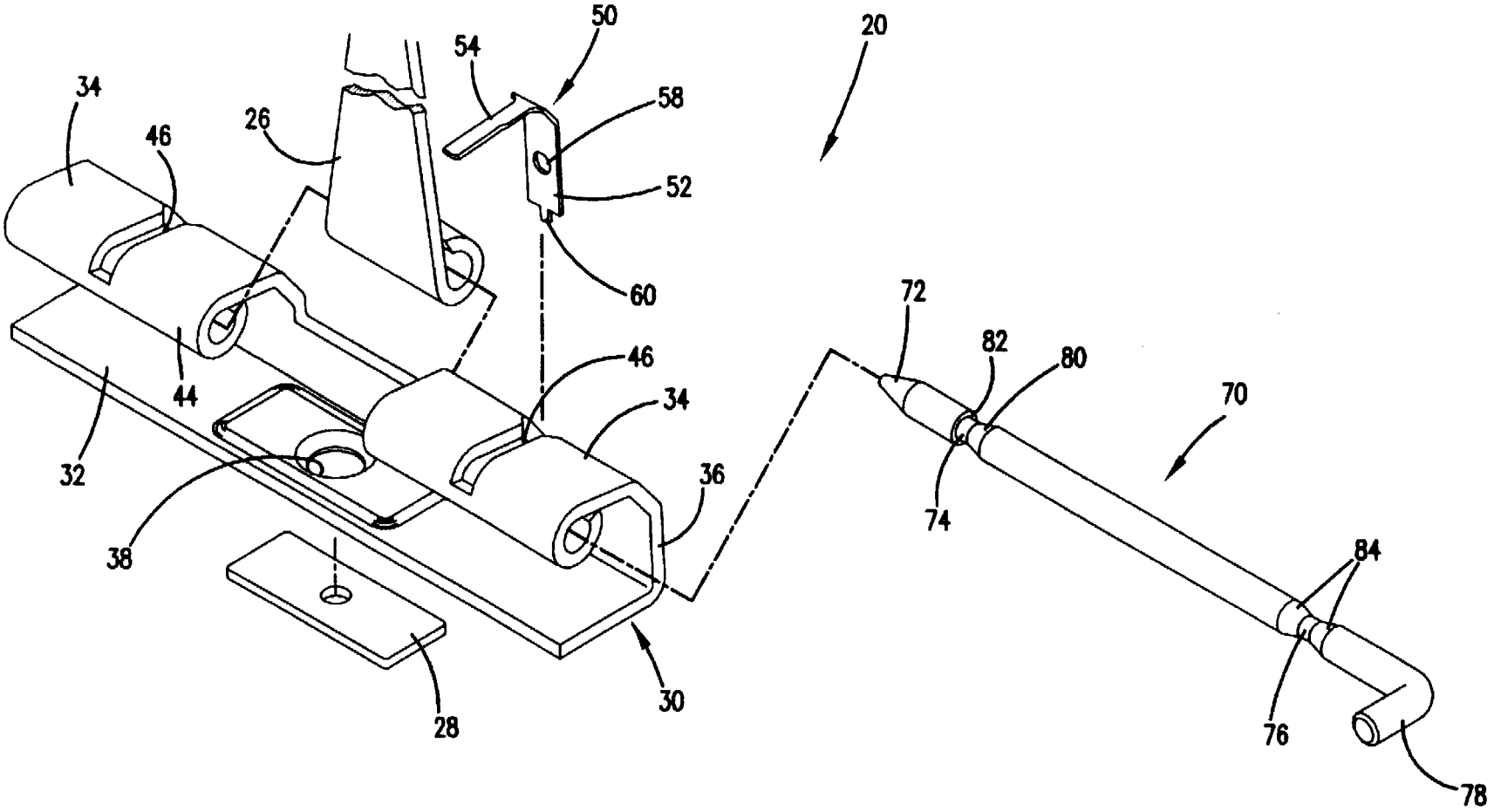
FIG. 1 shows an exploded perspective view of a hinge apparatus according to the principles of the present invention.

Referring now to the drawings, and in particular to FIG. 1, there is shown a hinge system, generally designated 20.

The hinge 20 includes a hinge body 30 connecting to a leaf 26 on a door or other enclosure member. It will be appreciated that the leaf portion may be integrally formed with the enclosure member and take on a number of configurations, depending on the requirements of the enclosure. The hinge 20 may also require a mounting gasket 28 should the enclosure require sealing. A hinge pin 70 inserts through the hinge body 30 in the leaf 26 and is held by a retaining member 50.

Figure 2:
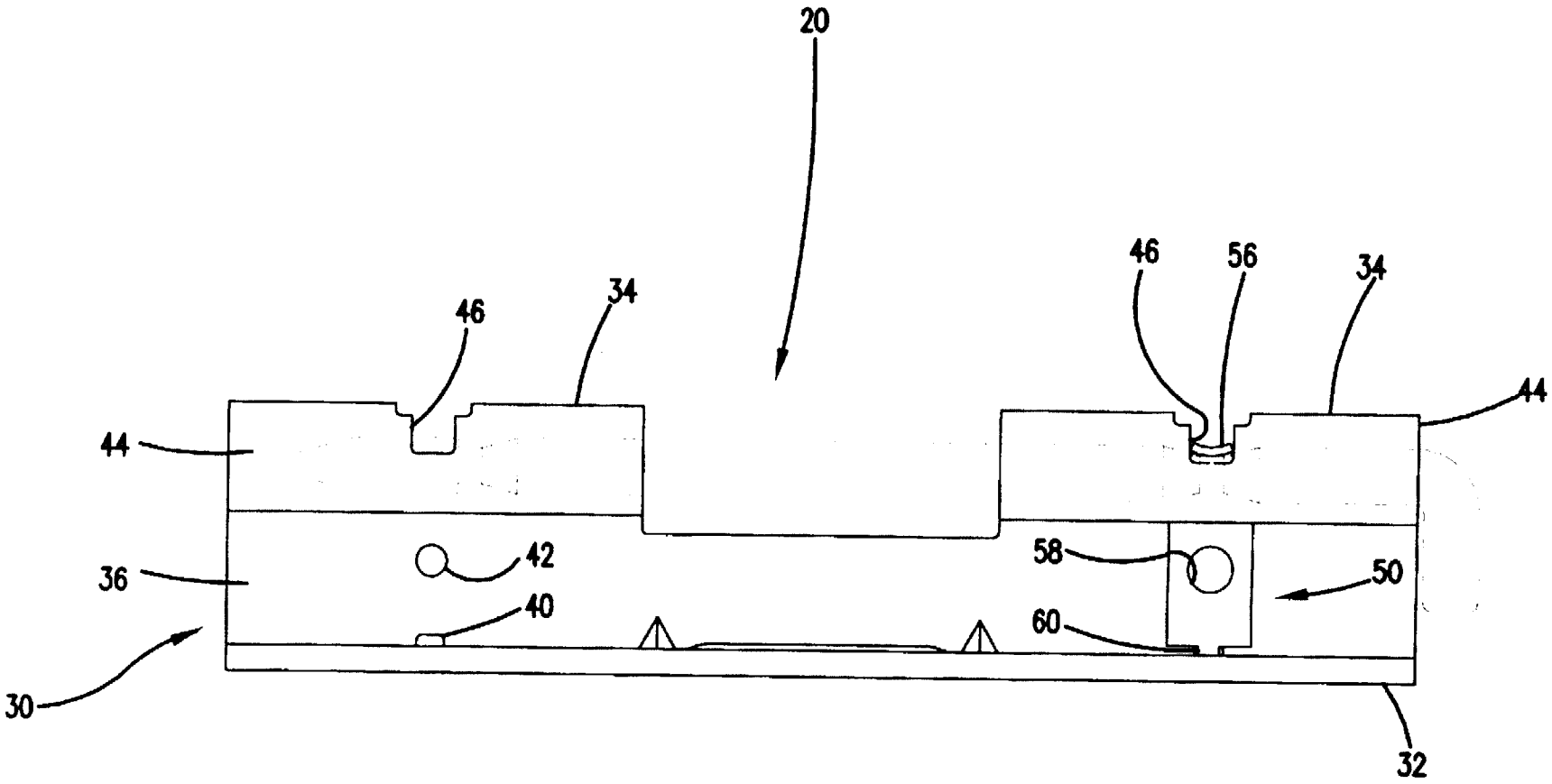
FIG. 2 shows a front elevational view of the hinge body of the apparatus shown in FIG. 1 with the pin shown in phantom and fully inserted.
Figure 3:
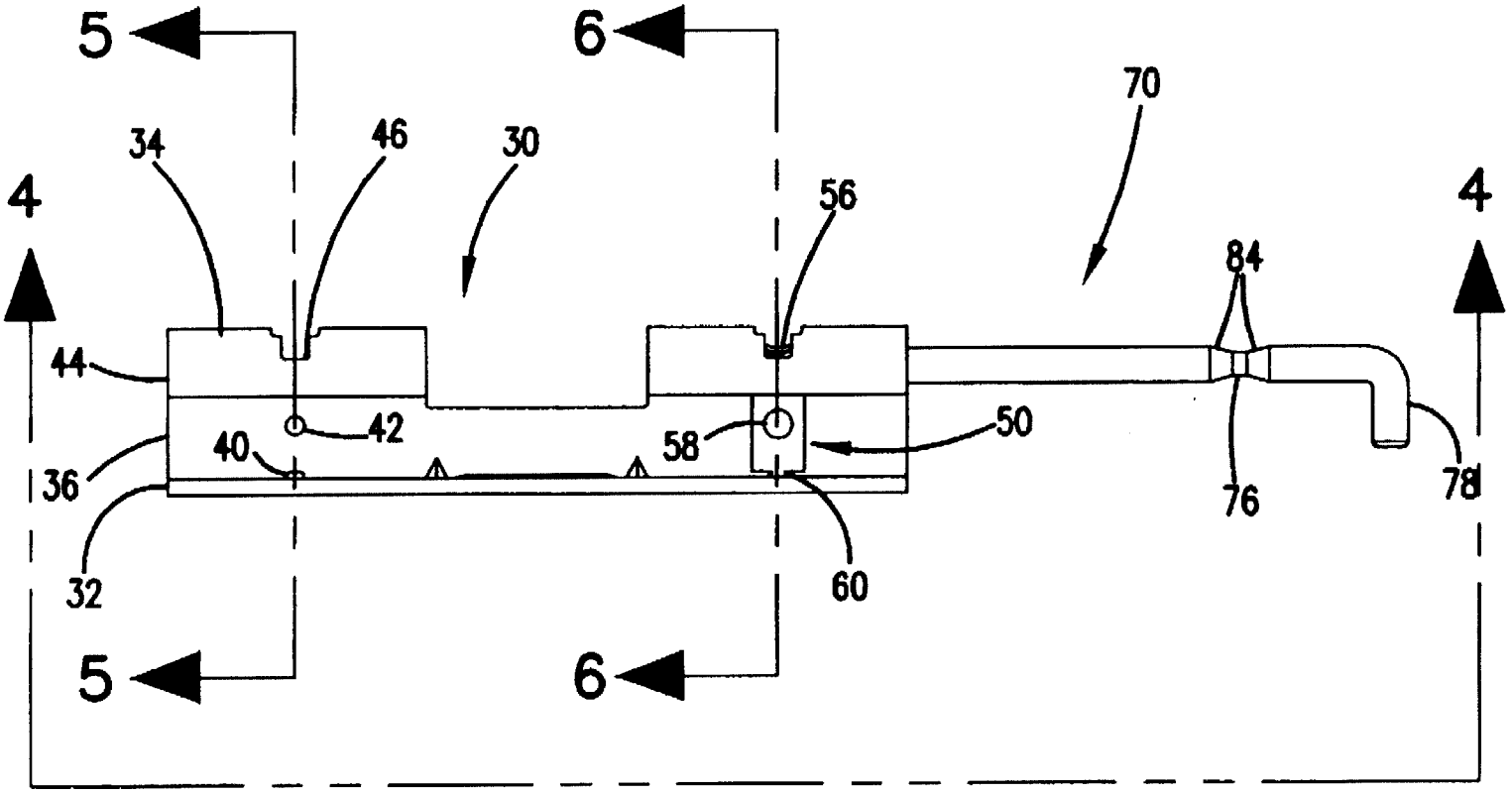
FIG. 3 shows a front elevational view of the hinge apparatus shown in FIG. 1 with the pin retained in one knuckle.
Figure 4:
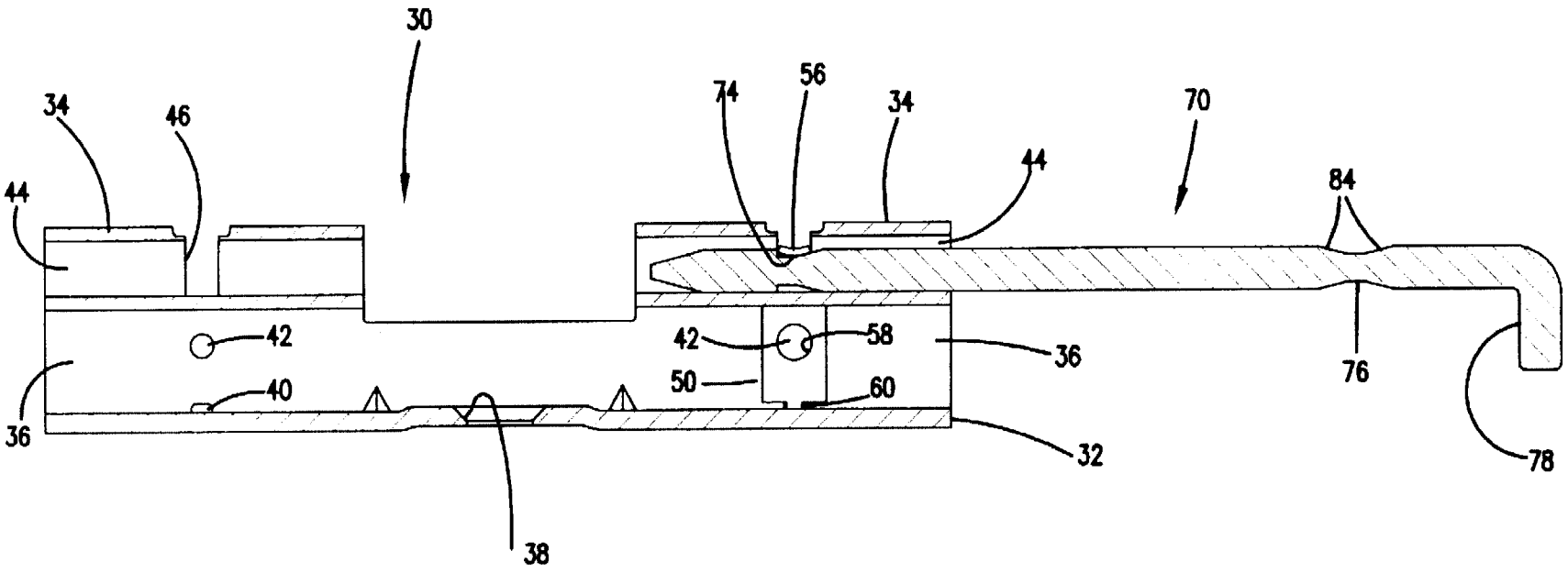
FIG. 4 shows a front sectional view taken along line 4—4 of FIG. 3.
Figure 5:
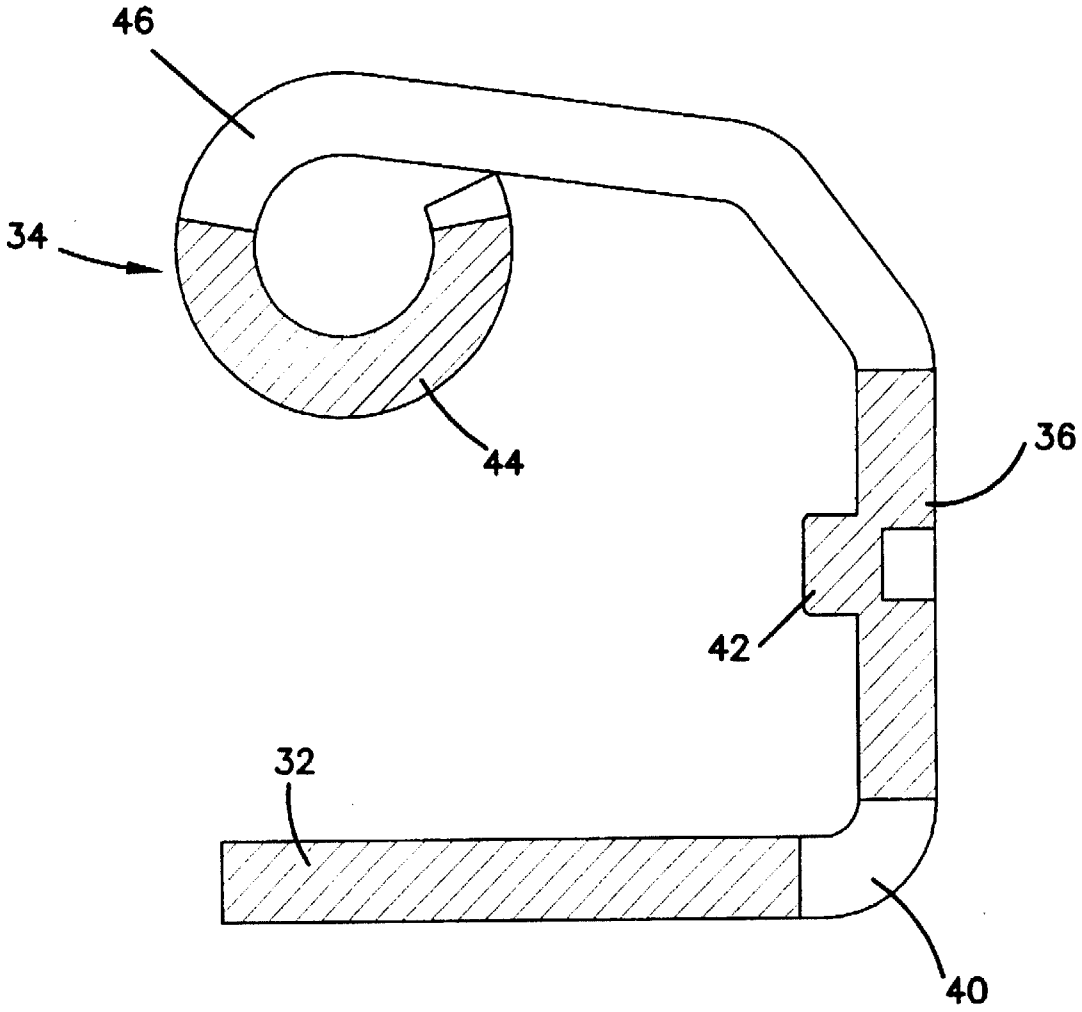
FIG. 5 shows a side sectional view taken along line 5—5 of FIG. 3.

The hinge body 30 includes a pair of aligned knuckles 34 which form a tubular opening receiving the pin 70, as also shown in FIGS. 2–4. The knuckles 34 are mounted on a riser portion 36 which extends upward from base 32. In the embodiment shown, the base 32 includes a mounting hole 38 aligned with the gasket 28 which receives a bolt or other mounting member for securing the hinge body 30 to a mounting surface. Tubular members 44 of knuckles 34 have openings 46 extending into the top and side thereof for receiving a pin retaining member, as explained hereinafter. In addition, radially aligned with the opening 46 are an alignment member 42 extending outward from the surface of the riser portion 36 and an orifice 40 at the intersection of the base 32 and the riser 36, for receiving an end of the retainer member, as explained hereinafter.

As shown in FIG. 1, the pin 70 includes a tapered first end 72 with a gripping portion 78 at the second end. It can be appreciated that the gripping portion 78 may take on a variety of configurations depending upon the positioning and needs of the enclosure. Near the tapered end 72, is formed a first annular groove 74. The first annular groove 74 includes a radially extending straight side 82 near the tapered end 72 and an opposed tapered side 80. A second annular groove 76 is placed near the gripping portion 78 and includes opposed tapering sides 84. The grooves 74 and 76 are engaged by the retaining member 50, as explained hereinafter.

Figure 7:
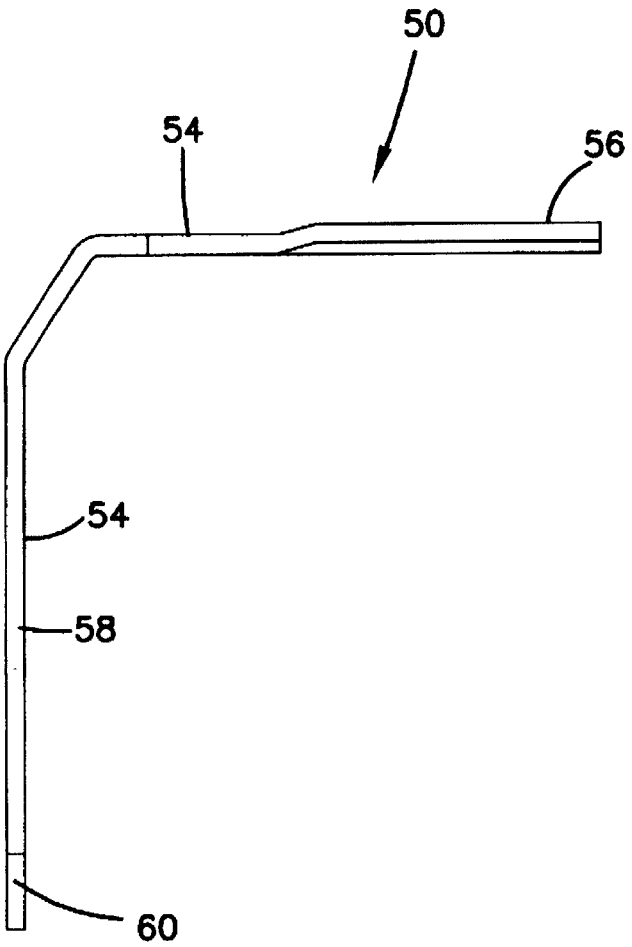

The retaining member 50, as shown in FIGS. 1 and 7, includes pin engaging portion 54 and a hinge body engaging portion 52. The portions 52 and 54 extend at substantially right angles to one another in the embodiment shown. The pin engaging portion 56 is configured for extending through the opening 46 formed in each of the knuckles 34 of the hinge body 30. The pin engaging portion 56 is arced upward away from the pin 70 and opening 46 to facilitate insertion of the pin 70 for sliding over the tapered sides of the pin. The base engaging portion 52 includes an orifice 58 formed therein which aligns with the alignment member 42 extending outward from the riser portion 36. An end extension 60 extends from the base engaging portion 52 into the orifice 40 formed at the base 32 and riser portion 36 of the hinge body 30.

Figure 6:
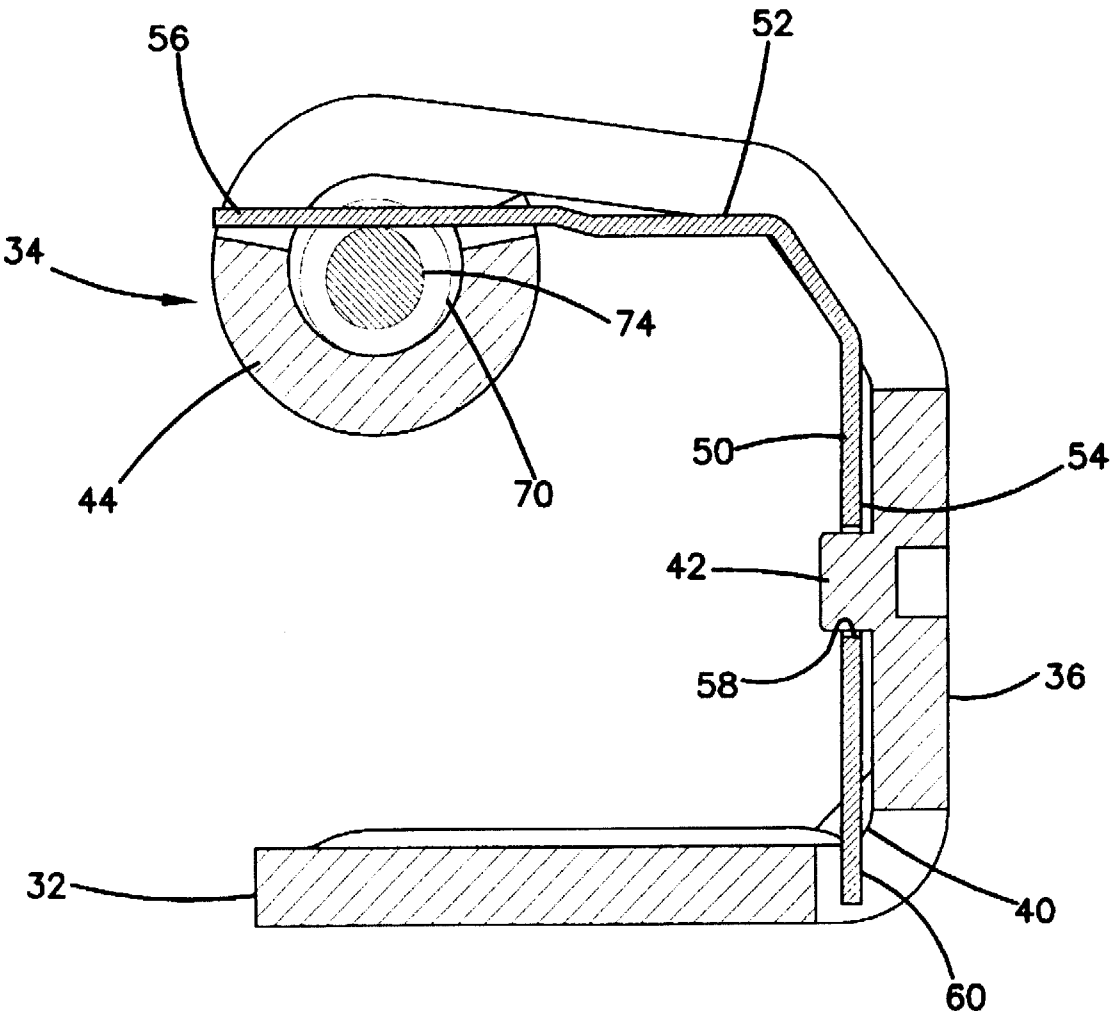
FIG. 6 shows a side sectional view taken along line 6—6 of FIG. 3; and, FIG. 7 shows a side elevational view of the pin retaining member for the hinge shown in FIG. 1.

As shown in FIG. 6, the geometry of the pin retaining member 50 and the hinge body 30 holds the pin retaining member 50 in place. Assembly requires only that extension 60 be inserted in the hole 40 and the orifice 58 be aligned with the alignment member 42. The pin engaging portion 54 is flexed upward to provide this alignment. However, when the pin engaging portion 54 is released, it will engage the lower portion of the opening 46 formed in the tubular portions 44 of the knuckles 34. The arcing portion 56 engages the pin 70 when inserted and aligns and retains the pin when engaging the grooves 74 and 76. It can be appreciated that the flexure of the pin retaining portion 56 when mounted to the hinge body 30 provides sufficient resistance to retain the pin 70 by inserting into and engaging the annular grooves 74 and 76. However, the resistance is such that the pin 70 may be slid axially with the pin retaining portion 56 riding over the tapered sides 80 and 84 of the grooves 74 and 76. However, the flexure is insufficient to provide for pulling the pin completely outward as the pin engaging portion 56 will abut the straight side 82 of the first groove 74, as shown in FIG. 4.

As shown in FIG. 2, when the pin 70 is fully inserted into the hinge body 30, the pin engaging portion 56 of the pin retaining member 50 abuts the annular groove 76 of the pin to retain the pin 70 in position. There is sufficient resistance to allow for sliding the pin 70 outward. However, the force is sufficient so that in normal operation, the pin 70 does not slide relative to the hinge body 30.

To disassemble the hinge 20, the pin 70 is pulled outward toward the position shown in FIGS. 3 and 4. This releases the pin from the leaf 26 to provide for disassembly. However, as the pin engaging portion 56 engages the annular groove 74, the pin 70 is still held and retained with the hinge body 30. Therefore, the pin 70 cannot be lost or misplaced when the hinge 20 is disassembled and is always aligned with the tubular openings in the knuckles 34. It can be appreciated that the pin 70 is prevented from fully sliding from the knuckles 34 by the pin engaging portion 56 of the pin retaining member 50 engaging the straight radially extending side 82 of the first groove 74 of the pin 70. It can also be appreciated that during initial assembly, the tapered end 72, as well as the tapered sides 80 and 84 provide for easily siding the pin 70 into a fully retained fully inserted position.

It can be appreciated that in the embodiment shown, only one pin retaining member is utilized as with the configuration of the present invention, only one pin retaining member is required. However, it can be appreciated that for some applications the hinge may need to be reversed for opening and closing in a direction opposite that from the configuration shown. However, with the present invention, the pin retaining member 50 may be mounted to the hinge body at the other of the knuckles 34. In this manner, the pin retaining member 50 is mounted at the left most knuckle, as shown in FIGS. 1 through 4, rather than the right knuckle 34.

With the present invention, an easily manufactured hinge body 30, retainer member 50 and pin 70 are utilized for a self-retaining hinge 20 which is adaptable to opening in either direction. With the embodiment shown, the hinge body 30 can be easily stamped to form the openings 38, 40 and 46, as well as the raised alignment member 42. In addition, the typically metal piece can be bent to form the base 32, the riser portion 36 and the knuckles 34. In addition, the pin retaining member 50 is also easily formed from a single piece which is adaptable to be inserted into either knuckle. With the embodiment shown, the hinge 20 is adaptable to a number of uses with a variety of opening configurations.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hinge apparatus, comprising:

a pin, including an annular groove formed therein;

a hinge body, including a base portion and at least one knuckle, the knuckle defining a tubular opening formed therein configured for receiving the pin, the knuckle including an orifice formed in a side thereof, and a riser portion extending between the base and the knuckle, the riser portion including an alignment member extending outward;

a pin retaining member having a portion extending into the orifice in the side of the knuckle, the pin retaining member including a portion mounted to the base and aligned by the riser portion.

2. A hinge apparatus according to claim 1, wherein the pin retaining member comprises an end portion extending through the orifice in the base portion, and an orifice formed in the pin retaining member configured for receiving the alignment member.

3. A hinge apparatus according to claim 2, wherein the orifice in the base is proximate the riser portion.

4. A hinge apparatus according to claim 2, wherein the orifice in the base, the orifice in the knuckle and the alignment member are in the same plane.

5. A hinge according to claim 1, wherein the pin retaining member is configured to extend into the orifice in the side of the knuckle and engage the groove in the pin.

6. A hinge apparatus according to claim 1, wherein the pin retaining member includes a narrowed finger portion extending into the orifice in the side of the knuckle.

7. A hinge apparatus according to claim 1, wherein the hinge body includes a pair of aligned knuckles.

8. A hinge apparatus according to claim 1, wherein the pin comprises a plurality of annular grooves formed therein.

9. A hinge apparatus according to claim 1, wherein the base portion includes an orifice formed therein.

10. A hinge apparatus according to claim 9, wherein the pin retaining member mounts to the orifice formed in the base portion.

11. A hinge apparatus, comprising:

a pin having an annular groove formed therein;

a hinge body comprising:

a base having an orifice formed therein;

a riser portion extending from the base and having an alignment member;

a pair of aligned knuckles mounted on the riser portion, wherein each of the knuckles defines a tubular portion configured for receiving the pin, and an orifice formed in the side of each of the tubular portions;

a pin retaining member having an upper portion configured for inserting into the orifice formed in a side of a first one of the tubular portions, and a lower portion inserting into the orifice in the base, wherein the lower portion includes a hole formed therein configured for receiving the alignment member.

12. A hinge apparatus according to claim 11, wherein the alignment member, the orifice in the base and the orifice in the first one of the tubular portions are substantially aligned in a single plane.

13. A hinge apparatus according to claim 11, wherein the upper portion of the pin retaining member includes an upward arcing lower surface.

14. A hinge body apparatus, comprising:

a base having an orifice formed therein;

a riser portion extending from the base and having an alignment member;

a pair of aligned knuckles mounted on the riser portion, wherein each of the knuckles defines a tubular portion and an orifice formed in the side of each of the tubular portions;

a retaining member having a first portion configured for inserting into the orifice formed in a side of a first one of the tubular portions, and a second portion extending at a substantially right angle to the first portion;

means for holding the second portion of the retaining member proximate the riser portion and the first portion against the first one of the tubular portions.

15. A hinge body according to claim 14, wherein the orifice formed in the base is configured for receiving an end of the second portion of the retaining member.

16. A hinge body according to claim 15, wherein the second portion of the retaining member includes a hole formed therein configured for receiving the alignment member.

17. A hinge body apparatus, comprising:

a hinge body, including a base portion and at least one knuckle, the knuckle defining a tubular opening; the knuckle including an orifice formed in a side thereof, and a riser portion extending from the base to the knuckle and including an alignment member extending outward;

a retaining member having a portion extending into the orifice in the side of the knuckle, the retaining member including a portion mounted to the base and aligned by the riser portion.

18. A hinge body apparatus according to claim 17, wherein the base portion includes an orifice formed therein.

19. A hinge body apparatus, comprising:

a hinge body, including a base portion and at least one knuckle, the base portion including an orifice formed therein, the knuckle defining a tubular opening and including an orifice formed in a side thereof; and a riser portion extending from the base to the knuckle, the riser portion including an alignment member extending outward;

a retaining member having a portion extending into the orifice in the side of the knuckle, the retaining member including a portion mounted to the orifice in the base and aligned by the riser portion.

* * * * *